United States Patent [19]

Dürl et al.

[11] Patent Number: 4,680,033

[45] Date of Patent: Jul. 14, 1987

[54] PROCESS FOR PRODUCING WHITE AND COLORED RESISTS ON POLYAMIDE FIBER MATERIALS USING REACTIVE DYE IN FREE VINYL SULPHONE FORM

[75] Inventors: Bernd Dürl, Kelkheim, Fed. Rep. of Germany; Johannes Bos, Rothrist, Switzerland; Sienling Ong; Peter Raffel, both of Hofheim am Taunus, Fed. Rep. of Germany; Kurt Brozat, Hünfelden, Fed. Rep. of Germany

[73] Assignee: Hoechst Aktiengesellschaft, Fed. Rep. of Germany

[21] Appl. No.: 791,209

[22] Filed: Oct. 25, 1985

[30] Foreign Application Priority Data

Oct. 29, 1984 [DE] Fed. Rep. of Germany ..... 3439532

[51] Int. Cl.[4] ..... D06P 3/24; D06P 5/12

[52] U.S. Cl. ..... 8/449; 8/446; 8/455; 8/549; 8/587; 8/591; 8/602; 8/604; 8/607; 8/608; 8/680; 8/685; 8/917; 8/924

[58] Field of Search ..... 8/449, 549, 591

[56] References Cited

U.S. PATENT DOCUMENTS

| | | | |
|---|---|---|---|
| 4,215,988 | 8/1980 | Kohama et al. | 8/448 |
| 4,265,629 | 5/1981 | Ribka et al. | 8/449 |
| 4,278,433 | 7/1981 | Blum et al. | 8/449 |

*Primary Examiner*—A. Lionel Clingman

*Attorney, Agent, or Firm*—Connolly and Hutz

[57] ABSTRACT

In the conventional discharge printing on polyamide fiber materials using acid dyes, above all, the very low wet and light fastness properties of the designs obtained in this manner are frequently an obstacle to the wide expansion of this interesting technique in practice. Applying this known patterning method for wool or nylon to resist prints made with reactive dyes being distinguished by better fastness level, does not always produce satisfactory white resist effects when, for example, sulfite compounds as the resist agent and reactive dyes having esterified $\beta$-hydroxyethylsulfonyl groups as the reactive radical are taken into consideration; colored effects having a bright hue are not even possible at all in various cases.

It has now been found that, using sulfite compounds and reactive dyes of the vinylsulfonyl type, the above mentioned difficulties can be remedied when, instead of the ester derivatives of said dyestuffs, according to this invention such dyes which have been converted before they are applied into the free vinylsulfonyl form, are brought to interaction with the preprinted resist agent to become immediately and completely desactivated and thus resulting unobjectionable resist effects at the respective places of the textile material.

13 Claims, No Drawings

PROCESS FOR PRODUCING WHITE AND COLORED RESISTS ON POLYAMIDE FIBER MATERIALS USING REACTIVE DYE IN FREE VINYL SULPHONE FORM

The present invention has for its object to obtain satisfactory white resists in the printing of natural and synthetic polyamide fiber materials and at the same time to provide the possibility of bright hues if colored resists are to be prepared.

Conventional discharge printing on textile materials in wool, silk and nylon in web form using acid dyes is, in engineering terms, a highly specialized kind of printing and as such harbors a whole series of error sources. A particular difficulty with discharge printing is the fact that only a very small number of discharge-resistant dyes are commercially available for this special printing technique; as a consequence, not every desired shade is obtainable in the case of colored effects. Moreover, the processes known heretofore and also used in practice are accompanied, owing to the action of aggressive discharging agents, by fiber damage. While the fact that occasionally the print pastes to be used lack stability might be just acceptable, the very low wet and light fastness properties of discharge prints produced in this conventional manner are usually an obstacle to the wide application of this interesting patterning technique in practice.

German Offenlegungsschrift No. DE-A-2,846,247 presents a process which concerns the preparation of white resists with reactive dyes and of colored resists with reactive dyes underneath reactive dyes using aldehyde/alkali metal bisulfite adducts as resist agents. The examples supporting this known technique are without exception based on reactive dyes having esterified $\beta$-hydroxyethylsulfonyl groups as the reactive radical, and moreover they solely support the application of the process described to cotton material. However, since the ester dyes of the type used are frequently incapable of sufficiently fast reaction with the resist agent, applying this patterning method to wool does not always produce satisfactory white resist effects; as a result, colored effects having a bright hue are not even possible at all in various cases.

It has now been found that, using compounds which have a resist action on reactive dyes which react with the fiber via the vinylsulfonyl form by nucleophilic addition for printing on textile sheetlike structures in polyamide fiber, it is possible to obtain satisfactory white and colored resists by interacting these resist agents, which are applied in the first print, on the textile material without exception only with dyes of the vinylsulfonyl type which have been converted before they are applied and which, in the now converted free vinylsulfonyl form, are immediately reactive with the fiber, bringing about immediate and complete deactivation.

In this way, according to the invention, the vinylsulfonyl dye is immediately blocked, so that this type of reactive dye is no longer capable of reacting with OH, $NH_2$ and other groups. Bonding to the fiber and reaction with the fiber is no longer possible in these circumstances and excellent white resist effects thus result on the polyamide fiber material underneath the reactive dyes of the background color. Since, on the other hand, reactive dyes of the halogenotriazinyl and halogenopyrimidinyl type and of similarly constituted reactive systems do not react with the sulfite compounds in the same way, it is possible to use such categories of dye to produce colored resists. Extensive experimental work has shown that the inactivation of the vinylsulfonyl group by means of sulfite compounds only goes to completion when the reactive dyes of the vinylsulfonyl type have been converted before printing into the reactive free vinylsulfonyl form and are not present in a form which of itself is not immediately reactive with the fiber substance, for example as esters of readily detachable monobasic or polybasic, inorganic or organic acids with $\beta$-hydroxyethylsulfonyl compounds.

The particular advantages of the new process are that, owing to the particular features of the invention, a large selection of dyes is available, that is to say that virtually every desired shade can be obtained. The results are brilliant hues, and the printing method is less complicated since the print pastes are simpler to prepare and moreover are much more stable. The greatest advantage is that it is possible in this way to obtain printed designs having much better light and wet fastness properties.

There are a number of possible ways of carrying out the claimed process itself. For instance, the resistable dye is applied to the material either by slop- or overpadding or by overprinting. However, in all cases the resist agent must already be present on the material.

For the purposes of the present invention, the resist agent can be any water-soluble inorganic sulfite compound such as an alkali metal or alkaline earth metal sulfite, any stabilized sulfite compound or any organic water-soluble or partially water-soluble sulfite compound. The resist agent can also be any aliphatic or aromatic amine, any monohydric or polyhydric alcohol of 2 to 10 carbon atoms or any inorganic or organic water-soluble halogen compound. It is preferable to use alkali metal sulfites or bisulfites or stabilized sulfite compounds such as aldehyde/alkali metal bisulfite adducts. Finally, according to the invention suitable resist agents are reaction products of bisulfite adducts of aldehydes having 2 to 6 carbon atoms or ketones and ammonia or primary or secondary amines in a molar ratio of 3:1 to 1:1, preferably bisulfite adducts of acetaldehyde and ammonia in a molar ratio of 3:1 to 1:1, in particular the sodium and potassium salts of 1,1',1''-nitrilotriethanesulfonic acid.

For the production of white resists, the only possible reactive dyes for coloring the background are those which after appropriate preactivation, can form a free vinyl-sulfonyl group as a reactive substituent.

Dyes for preparing colored resist effects are those which are suitable for application to natural and synthetic polyamide fibers and which are resistant to the above-mentioned resist agents. In the process, this function is performed by reactive, metal complex and acid dyes. Before use in practice these dyes are put through a special test procedure if they have been found to be resistant to the abovementioned resist agents.

The claimed process is carried out in detail by applying in the first print either the white or the colored resist or white and colored resists together. The converted vinylsulfonyl dyes are then overprinted onto this first print resist without drying, that is to say wet-on-wet, and the textile material thus treated is then dried at 80° C. to 110° C. To fix the design, this is followed by steaming for 10 to 15 min at 100° to 106° C. with saturated steam; printing is concluded with an ammoniacal aftertreatment of the dyeing.

In another version of the process, the white and/or the colored resists are printed on first and are then first dried at 85° C. to 100° C. The material is then overpadded with a padding liquor comprising converted and activated vinylsulfonyl dye on a pad-mangle or by means of a slop-padding apparatus, and is dried at 80° to 110° C. Steaming and aftertreatment are the same as in the first version of the process.

In this way the present invention produces satisfactory white and colored resist prints.

EXAMPLE 1

To prepare a colored resist, a print paste of the following composition

| | |
|---|---|
| 500 g | of alginate (10% strength, medium viscosity), |
| 40 g | of sodium acetate, |
| 100 g | of urea, |
| 46 g | of sodium sulfite ($Na_2SO_3$), |
| 4 g | of sodium disulfite ($Na_2S_2O_5$), |
| 294 g | of water and |
| 16 g | of the reactive dye of the formula |
| 1000 g | |

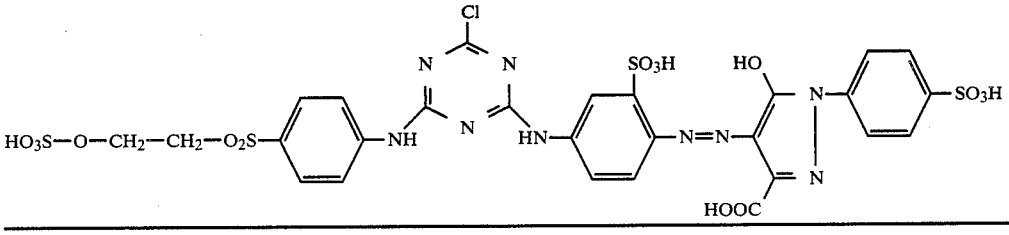

was printed by means of a screen-printing screen onto chlorinated wool muslin. Without drying, this first print was overprinted with a second print paste in the form of an emulsion thickening which had the following composition:

The vinylsulfonyl dye in the second print paste has beforehand been dissolved at 80° C. in the indicated amount of water, and the solution, after cooling down to around room temperature, had added to it 11 g of 38° Bé sodium hydroxide solution. After 10 min of stirring, this solution was brought to pH 6.5–7 with 30% strength acetic acid and was incorporated into the emulsion thickening, and this print paste was applied.

The printed material was then dried at 80° C. and was subsequently steamed at 102° C. for 10 min. The aftertreatment took the form of an ammoniacal wash.

The result was a satisfactory wool resist print comprising a light golden yellow pattern and a blue ground. In the overprint areas, no fixing of the blue overprint dye had occurred.

EXAMPLE 2

A wool flannel cloth was printed with a first print paste having the composition of Example 1, except that the yellow dye thereof is replaced by 18 g of the reactive dye of the formula

| | |
|---|---|
| 16 g | of the reactive dye of the formula |

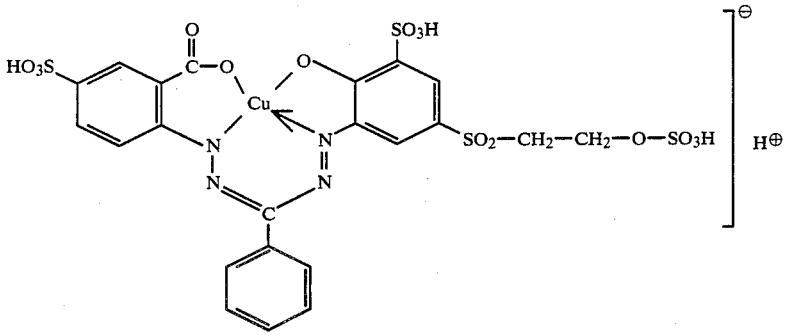

| | |
|---|---|
| 550 g | of water, |
| 30 g | of alginate, |
| 100 g | of urea, |
| 15 g | of sodium m-nitrobenzenesulfonate, |
| 5 g | of polyglycol stearate and |
| 150 g | of univeral spirit, |
| | made up with water to |
| 1000 g | |

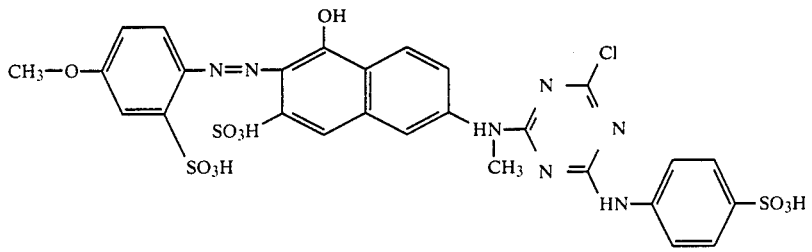

and was then overprinted wet-on-wet, i.e. without intermediate drying, with the second print paste of Example 1, including the same pretreatment of the dye.

The result was a deep scarlet pattern on blue ground in the same quality as Example 1.

EXAMPLE 3

A print paste of the following composition

| | |
|---|---|
| 500 g | of bean flour ether (12% strength, low viscosity), |
| 40 g | of sodium acetate, |
| 100 g | of urea, |
| 100 g | of glyoxal bisulfite, |
| 220 g | of water and |
| 18 g | of the reactive dye of the formula |

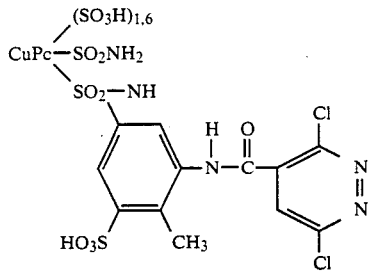

| | |
|---|---|
| | made up with water to |
| 1000 g | |

was printed as a colored resist onto a wool fabric. Intermediate drying at 80° C. for 6 min was followed by overprinting with a second print paste comprising

| | |
|---|---|
| 15 g | of a dye which was a copper complex of diazotized 1-amino-2-hydroxybenzene-4-β-hydroxyethylsulfonyl sulfate coupled with 1-naphthol-4-sulfonic acid and had been preactivated as described in Example 1, and also |
| 550 g | of water, |
| 30 g | of alginate, |
| 100 g | of urea, |
| 5 g | of polyglycol stearate and |
| 150 g | of universal spirit, |
| | made up with water to |
| 1000 g | |

Drying at about 80° C. was followed by steaming the material at 105° C. for 8 min. The aftertreatment took the form of an ammoniacal wash.

The result was a turquoise blue/claret pattern having satisfactory contours.

EXAMPLE 4

A first print paste, for a pure white resist, of the following composition

| | |
|---|---|
| 500 g | of 10% strength alginate thickening, |
| 5 g | of a mixture of medium and high-molecular polyphosphates, |
| 100 g | of glyoxal bisulfite and |
| 395 g | of water |
| 1000 g | |

was applied by screen-printing to a pure wool fabric and was dried at about 85° C.

The overprint paste was then applied to the material by padding using a nip padder. This overprint paste had been prepared as follows:

14 g of the reactive dye of the formula

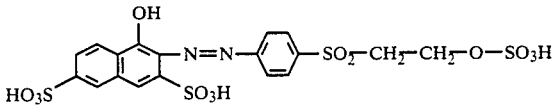

were dissolved in

| | |
|---|---|
| 550 g of | water at about 80° C. The solution was allowed to cool down and then, as soon as room temperature had approximately been reached, |
| 11 g of | 38° Be sodium hydroxide solution were added with constant stirring. After 8 min the solution was brought to pH 6.5–7 by means of 30% strength acetic acid. Then |
| 100 g of | urea, |
| 15 g of | sodium m-nitrobenzenesulfonate and |
| 50 g of | 10% strength alginate were added |

and the padding liquor was finally made up with water to 1000 g.

This padding liquor was used to pad the wool fabric in a nip padded with a liquor pickup of 85% (on weight of fiber), and the fabric was then dried and was steamed at 104° C. with saturated steam for 9 min.

After an ammoniacal aftertreatment of the dyeing the result was a medium brilliant orange shade with satisfactory white resist.

We claim:

1. In a process for preventing fixation of a vinyl sulfone-type fiber-reactive dyestuff at selected places on a sheetlike textile material, wherein the textile material is first printed in the desired pattern with a white or colored resist paste containing a resist agent for said dyestuff and this pattern is then over-printed, over-padded or over-slop padded with an aqueous paste or dyeing liquor containing the resistable reactive dyestuff, whereby the resist agent deactivates the fiber-reactive moiety of the resistable reactive dyestuff in accordance with the said pattern, and wherein the textile material is subsequently heated in order to fix the resisted pattern and the dyeing with the resistable dyestuff wherever it is still fiber-reactive, the improvement which comprises:

treating a polyamide fiber-containing material as the textile material, and selecting as said resistable reactive dyestuff a dyestuff of the vinyl-sulfone type whose fiber-reactive moiety is either:

(a) present from the outset in the free vinylsulfonyl form, or is (b) a precursor of this vinylsulfonyl form derived from esters of mono- or polyvalent, inorganic or organic acids with $\beta$-hydroxyethylsulfonyl compounds, which has been converted into the free vinylsulfonyl form, before preparation and application of the said aqueous paste or dyeing liquor to the textile material, by treating with alkaline agents.

2. The process as claimed in claim 1, wherein the polyamide fiber-containing material used is made of wool and silk.

3. The process as claimed in claim 1, wherein the polyamide fiber-containing material used is made of nylon fibers.

4. The process as claimed in claim 1, wherein the resist agent or agents used are essentially a water-soluble, inorganic or organic sulfite compound or a mixture thereof.

5. The process as claimed in claim 1, wherein the resist agent or agents used are essentially a water-soluble, aliphatic or aromatic amine or a mixture thereof.

6. The process as claimed in claim 4, wherein the resist agent or agents used are alkali metal sulfites or bisulfites.

7. The process as claimed in claim 4 wherein the resist agent or agents are stabilized sulfite compounds based on an aldehyde/alkali metal bisulfite adduct.

8. The process as claimed in claim 4, wherein the resist agent or agents comprise a reaction product of a bisulfite adduct of an aldehyde or ketone and ammonia or a primary or secondary amine.

9. The process as claimed in claim 4, wherein the resist agent or agents comprise a sodium or potassium salt of 1,1′,1″-nitrilotriethanesulfonic acid.

10. The process as claimed in claim 1, wherein the resist agent is applied either separately, to provide a white resist, or together with one or more dyes which are stable to the resist agents, to provide a colored resist.

11. The process as claimed in claim 10, wherein the dye used as stable to resist agents is a reactive dye free of vinylsulfonyl groups.

12. The process as claimed in claim 10, wherein the dye used as stable to resist agents is a metal complex dye.

13. The process as claimed in claim 10, wherein the dye used as stable to resist agents is an acid dye.

* * * * *